US008797218B2

(12) United States Patent
Kim et al.

(10) Patent No.: US 8,797,218 B2
(45) Date of Patent: Aug. 5, 2014

(54) INTERNAL ANTENNA JOINED TO TERMINAL HOUSING

(75) Inventors: Byong-Nam Kim, Kyeonggi-do (KR); Jong-Ho Jung, Gyeonggi-do (KR)

(73) Assignee: Ace Technologies Corporation, Incheon-si (KR)

( * ) Notice: Subject to any disclaimer, the term of this patent is extended or adjusted under 35 U.S.C. 154(b) by 250 days.

(21) Appl. No.: 13/305,548

(22) Filed: Nov. 28, 2011

(65) Prior Publication Data

US 2012/0133562 A1 May 31, 2012

(30) Foreign Application Priority Data

Nov. 29, 2010 (KR) ..... 10-2010-0119668

(51) Int. Cl.
*H01Q 1/24* (2006.01)
*H01Q 1/38* (2006.01)

(52) U.S. Cl.
USPC ..... 343/702

(58) Field of Classification Search
CPC ..... H01Q 1/24
USPC ..... 343/702
See application file for complete search history.

(56) References Cited

U.S. PATENT DOCUMENTS

| | | | | |
|---|---|---|---|---|
| 6,734,825 | B1 * | 5/2004 | Guo et al. | 343/700 MS |
| 6,819,287 | B2 * | 11/2004 | Sullivan et al. | 343/700 MS |
| 2003/0174092 | A1 * | 9/2003 | Sullivan et al. | 343/702 |
| 2004/0104851 | A1 * | 6/2004 | Kadambi et al. | 343/700 MS |
| 2011/0181487 | A1 | 7/2011 | Kim et al. | |

FOREIGN PATENT DOCUMENTS

| | | |
|---|---|---|
| KR | 10-2008-0019778 | 3/2008 |
| KR | 10-2009-0126001 | 12/2009 |

* cited by examiner

*Primary Examiner* — Jerome Jackson, Jr.
*Assistant Examiner* — Andrea Lindgren Baltzel
(74) *Attorney, Agent, or Firm* — AlbertDhand LLP

(57) ABSTRACT

An internal antenna for attaching to a terminal housing is disclosed. The antenna includes: a perpendicular structure formed in a perpendicular direction to a substrate and positioned in contact with an inner wall of a housing; a first conductive member electrically connected to a power feed and joined to the perpendicular structure to extend in a perpendicular direction to the substrate; and a second conductive member electrically connected to a ground, joined to the perpendicular structure, and separated by a particular distance from the first conductive member to extend in a perpendicular direction to the substrate. The first conductive member is joined to the inner wall of the housing to extend in a first direction orthogonal to the perpendicular direction, and the second conductive member is joined to the inner wall of the housing to extend in the first direction at a particular distance from the first conductive member.

5 Claims, 5 Drawing Sheets

INTERNAL ANTENNA JOINED TO TERMINAL HOUSING

TECHNICAL FIELD

Embodiments of the present invention relate to an internal antenna, more particularly to an internal antenna having a portion thereof attached to the housing of a terminal.

BACKGROUND ART

Recent demands call for mobile communication terminals which not only are smaller and lighter, but also provide functionality for enabling mobile communication services of different frequency bands. There is a demand for terminals that can simultaneously utilize signals of multiple bands as necessary, from among mobile communication services using various frequency bands, such as, for example, the CDMA service of the 824-894 MHz band and the PCS service of the 1750-1870 MHz band commercialized in Korea, the CDMA service of the 832-925 MHz band commercialized in Japan, the PCS service of the 1850-1990 MHz band commercialized in the U.S., the GSM service of the 880-960 MHz band commercialized in Europe and China, and the DCS service of the 1710-1880 MHz band commercialized in parts of Europe.

Because of such demands for multi-band and broadband capabilities, as well as the demands for smaller and slimmer terminals, there is a continued demand for minimizing the space for mounting the antenna.

The inverted-F antenna generally used in the past carries the advantages of low profile and adequate SAR characteristics, but is not suited for implementing broadband and broadband characteristics.

A structure for forming an antenna on the housing of the terminal has been proposed, in order to minimize the mounting space of the antenna, but this structure also entails difficulties in implementing broadband characteristics.

DISCLOSURE

Technical Problem

In order to resolve the above problem in the related art, the present invention proposes an internal antenna which provides broadband characteristics and which is attached to the housing of the terminal.

Another objective of the present invention is to propose an antenna that can be attached to the terminal housing to minimize mounting space.

Technical Solution

To achieve the objectives above, a preferred embodiment of the present invention provides an internal antenna for attaching to a terminal housing that includes: a perpendicular structure formed in a perpendicular direction to a substrate and positioned in contact with an inner wall of a housing; a first conductive member electrically connected to a power feed and joined to the perpendicular structure to extend in a perpendicular direction to the substrate; and a second conductive member electrically connected to a ground, joined to the perpendicular structure, and separated by a particular distance from the first conductive member to extend in a perpendicular direction to the substrate, where the first conductive member is joined to the inner wall of the housing to extend in a first direction orthogonal to the perpendicular direction, and the second conductive member is joined to the inner wall of the housing to extend in the first direction at a particular distance from the first conductive member, and where the internal antenna further includes a third conductive member extending from the second conductive member joined to the inner wall of the housing in a direction moving further away from the first conductive member.

A multiple number of open stubs may protrude from the first conductive member and the second conductive member along a second direction perpendicular to an extending direction of the first conductive member and the second conductive member joined to the inner wall of the housing.

The multiple open stubs protruding from the first conductive member and the second conductive member may preferably protrude alternatingly.

The internal antenna can further include a dielectric protrusion having a meandering structure that protrudes from the inner wall of the housing.

The dielectric protrusion having a meandering structure may include an inner sidewall and an outer sidewall, where the first conductive member joined to the perpendicular structure may extend while joined to the inner sidewall.

The second conductive member joined to the perpendicular structure may extend while joined to the outer sidewall.

Advantageous Effects

An antenna according to an aspect of the present invention provides the advantages of enabling broadband characteristics while being attached to the housing of the terminal to minimize mounting space.

MODE FOR INVENTION

Figure 1:
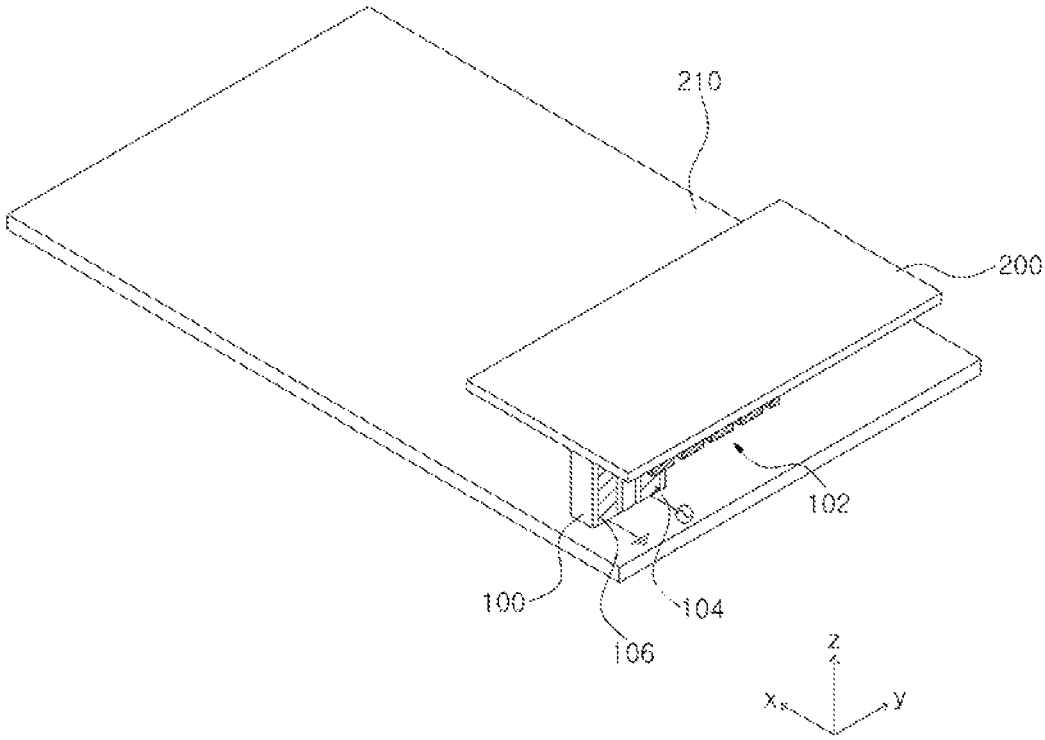
FIG. 1 is a perspective view of an antenna according to an embodiment of the present invention.

As the present invention allows for various changes and numerous embodiments, particular embodiments will be illustrated in the drawings and described in the detailed description. However, this is not intended to limit the present invention to particular modes of practice, and it is to be appreciated that all changes, equivalents, and substitutes that do not depart from the spirit and technical scope of the present invention are encompassed in the present invention. In describing the drawings, similar reference numerals are used for similar components.

Certain embodiments of the present invention will be described below in more detail, with reference to the accompanying drawings.

Figure 2:
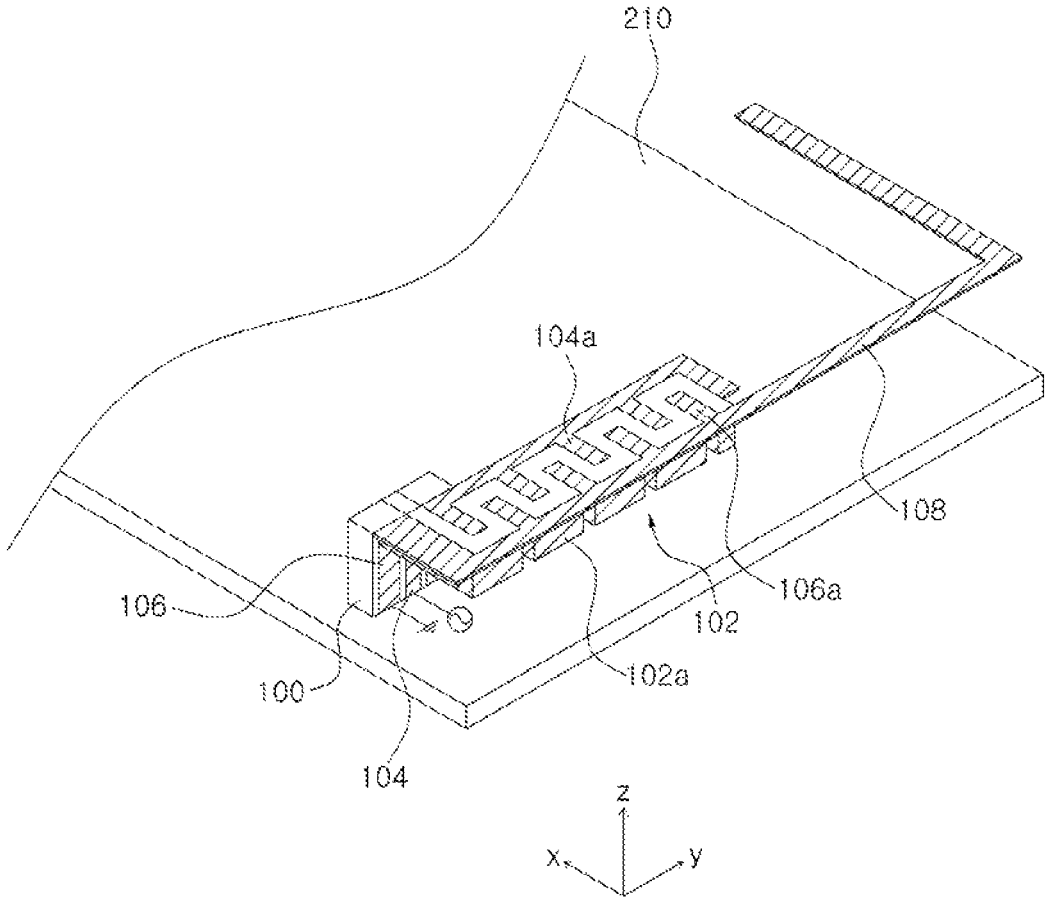
FIG. 2 is a perspective view of an antenna according to an embodiment of the present invention with the terminal housing removed, as seen from a first direction.
Figure 3:
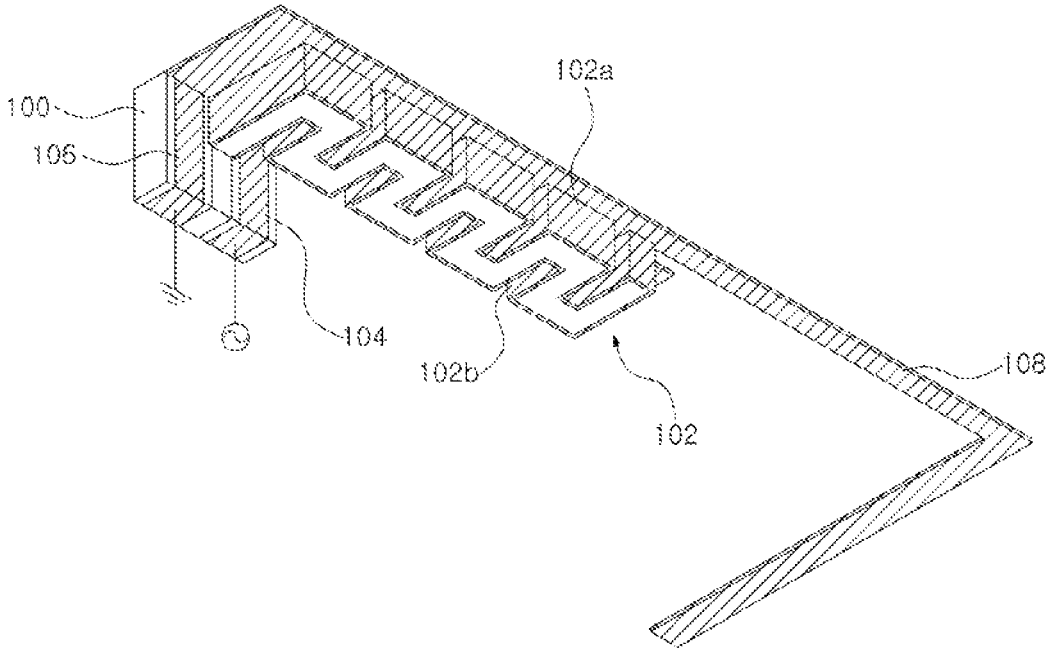
FIG. 3 is a perspective view of an antenna according to an embodiment of the present invention with the terminal housing removed, as seen from a second direction.

FIG. 1 is a perspective view of an antenna according to an embodiment of the present invention, FIG. 2 is a perspective view of an antenna according to an embodiment of the present invention with the terminal housing removed as seen from a first direction, and FIG. 3 is a perspective view of an antenna according to an embodiment of the present invention with the terminal housing removed as seen from a second direction.

Referring to FIG. 1 through FIG. 3, an antenna according to an embodiment of the present invention can include a perpendicular structure 100; a dielectric protrusion 102 having a meandering structure extending from an inner wall of the terminal housing 200; a first conductive member 104 that is electromagnetically connected to a feeding point and is formed on the perpendicular structure 100, the protrusion 102, and the inner wall of the housing; a second conductive member 106 that is electrically connected to a ground and is joined to the perpendicular structure 100, the protrusion 102, and the inner wall of the housing 200; and a third conductive member 108 that extends from the second conductive member 106 and is formed to join to the inner wall of the housing 200.

The perpendicular structure 100 may be made of a dielectric material and may be formed in a perpendicular direction to the substrate 210 inside the terminal. The first conductive member 104 electromagnetically connected with the feeding point of the substrate 210 may be joined to the perpendicular structure 100 to extend in a direction perpendicular to the substrate 210.

Also, the second conductive member 106 electrically connected with the ground of the substrate 210 may be joined to the perpendicular structure 100 to extend in a perpendicular direction to the substrate 210 and may be separated from the first conductive member 104. Here, the distance between the second conductive member 106 and the first conductive member 104 may be a distance for which electromagnetic coupling is possible.

The perpendicular structure 100 may be in contact with the inner wall of the terminal housing 200 and the dielectric protrusion 102 having a meandering structure that extends in the y direction from the inner wall. The dielectric protrusion 102 having a meandering structure may include an outer sidewall 102*a*, which corresponds to the outer side in FIG. 3, and an inner sidewall 102*b*, which corresponds to the opposite side.

The first conductive member 104 joined to the perpendicular structure and extending in the perpendicular direction (z direction) may be joined to the housing's inner wall. As illustrated in FIG. 2, the first conductive member 104 can extend in the y direction while joined to the inner wall of the housing.

As illustrated in FIG. 3, the first conductive member 104 may also be joined to the inner sidewall 102*b* of the dielectric protrusion 102 having a meandering structure.

Furthermore, a multiple number of open stubs 104*a* protruding in the x direction, perpendicular to the y direction, may be formed on the first conductive member where it is joined to the inner wall of the housing to extend in the y direction, with the open stubs 104*a* joined to the inner wall of the housing.

The second conductive member 106 connected to the ground of the substrate 210 may be joined to the perpendicular structure 100 and may extend in a perpendicular direction to the substrate 210. Here, the second conductive member 106 may be joined to the perpendicular structure 100 with a particular distance from the first conductive member 104, where the distance on the perpendicular structure 100 may be a distance for which electromagnetic coupling is possible.

Referring to FIG. 2, the second conductive member 106 that is joined to the perpendicular structure to extend in the perpendicular direction (z direction) may extend while joined to the inner wall of the housing, and may, for example, extend in parallel with the first conductive member 104 with a gap in-between. As illustrated in FIG. 2, the second conductive member 106 may be joined to the inner wall of the housing to extend in the y direction.

As illustrated in FIG. 3, the second conductive member 106 may also be joined to the outer sidewall 102*a* of the dielectric protrusion 102 having a meandering structure.

Furthermore, a multiple number of open stubs 106*a* protruding in the x direction, perpendicular to the y direction, may be formed on the second conductive member where it is joined to the inner wall of the housing to extend in the y direction, with the open stubs 106*b* joined to the inner wall of the housing. Here, the open stubs 106*b* may protrude into the space between the first conductive member 104 and second conductive member 106 joined to the inner wall of the housing.

The open stubs 104*a*, 106*a* protruding from the first conductive member 104 and second conductive member 106 may preferably protrude alternatingly.

By virtue of the structure described above, coupling can occur in three zones on the first conductive member and second conductive member.

A first coupling can occur on the perpendicular structure 100 between the separated first conductive member and second conductive member, a second coupling can occur between the first conductive member and second conductive member as they extend in the y direction while joined to the inner wall of the housing, and a third coupling can occur between the first conductive member joined to the inner sidewall 102*b* and the second conductive member joined to the outer sidewall 102*a* on the dielectric protrusion 102 having a meandering structure.

Here, zones where coupling occurs may be of a length sufficient to generate a progressive wave, and may preferably have a length of at least 0.1λ. As the structure of the present invention is relatively long and allows coupling in various zones, it is possible to provide improved broadband characteristics.

The open stubs 104*a*, 106*a* protruding alternatingly from the first conductive member 104 and second conductive member 106 may be formed alternatingly in an interlocking manner to form a slow-wave structure and may vary the capacitance, to thereby substantially increase the electrical length of the first conductive member 104 and second conductive member 106 joined to the inner wall of the housing.

The third conductive member 108 may extend from the second conductive member 106 to be joined to the inner wall of the housing. The third conductive member 108 may extend in a direction moving further away from the first conductive member 104. The third conductive member 108 may begin at the portion where coupling with the first conductive member 104 ends.

The third conductive member 108 may operate as a radiator, and the radiating frequency can be determined by the lengths of the third conductive member 108 and the second conductive member.

Figure 4:
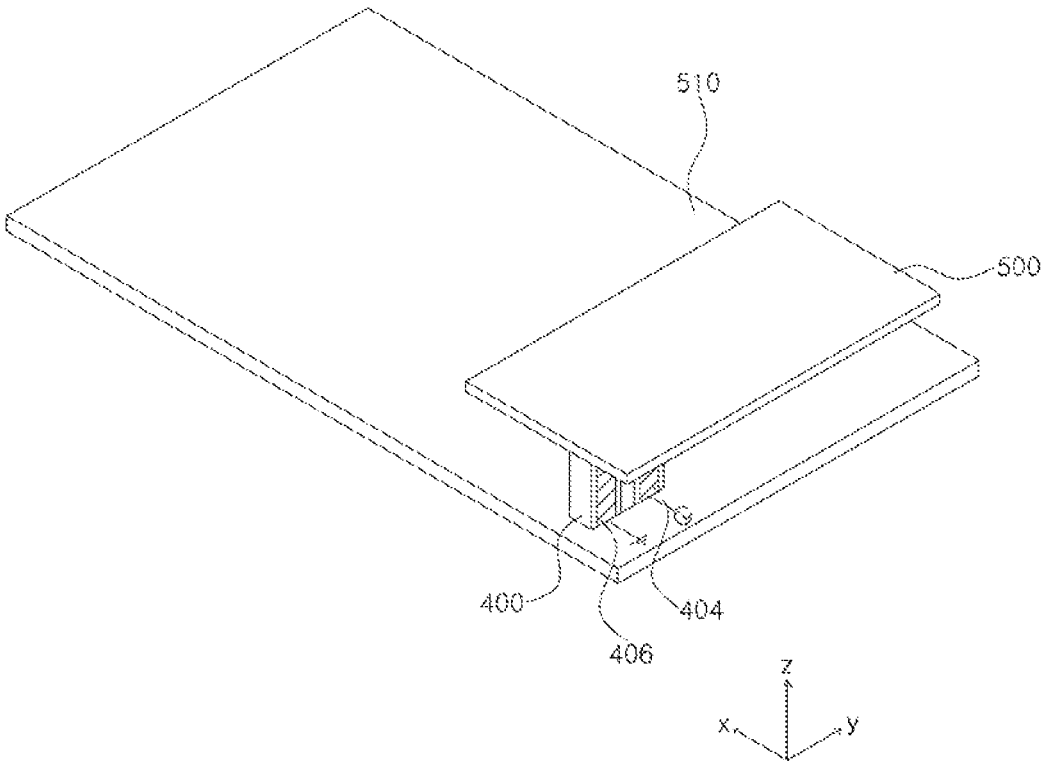
FIG. 4 is a perspective view of an antenna according to another embodiment of the present invention.
Figure 5:
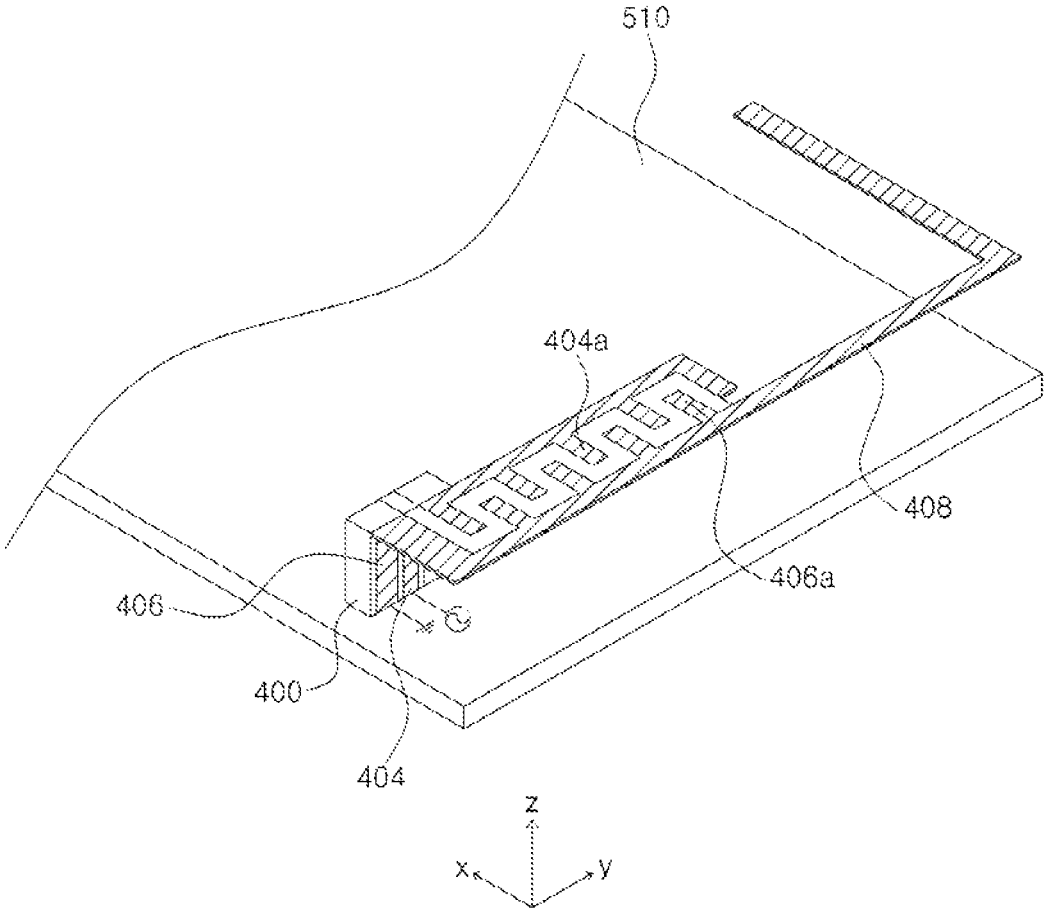
FIG. 5 is a perspective view of an antenna according to an embodiment of the present invention with the terminal housing removed.

FIG. 4 is a perspective view of an antenna according to another embodiment of the present invention, and FIG. 5 is a perspective view of an antenna according to an embodiment of the present invention with the terminal housing removed.

Referring to FIG. 4 and FIG. 5, an antenna according to another embodiment of the present invention can include a perpendicular structure 400; a first conductive member 404 that is electromagnetically connected with a power feed point and is joined to the perpendicular structure 400 and the inner wall of the housing 500; a second conductive member 406 that is electrically connected with a ground and is joined to the perpendicular structure 400 and to the inner wall of the housing 500; and a third conductive member 108 that extends from the second conductive member 406 and is formed to be joined to the inner wall of the housing 500.

The antenna according to another embodiment of the present invention illustrated in FIG. 4 and FIG. 5 differs from the antenna illustrated in FIG. 1 through FIG. 3, in that the dielectric protrusion having a meandering structure formed on the inner wall of the housing 500 is omitted.

In the antenna illustrated in FIG. 4 and FIG. 5, the form of the perpendicular structure 100, as well as the forms and functions of the first conductive member 404 and second conductive member 406 joined to the perpendicular structure, are the same as those of the antenna shown in FIG. 1 through FIG. 3.

However, because there is no dielectric protrusion of a meandering structure protruding from the inner wall of the housing, the first conductive member 404 and the second conductive member 406 may be joined only to the perpendicular structure 400 and the inner wall of the housing 500.

As illustrated in FIG. 5, the first conductive member 404 that is joined to the perpendicular structure 400 and extending in the perpendicular direction may extend while joined to the inner wall of the housing, extending for example in the y direction.

The second conductive member 406 that is joined to the perpendicular structure 400 and extending in the perpendicular direction with a particular distance from the first conductive member 404 may also extend while joined to the inner wall of the housing, and on the inner wall of the housing also, may maintain a distance from the first conductive member 404 that enables coupling.

A multiple number of open stubs 404*a*, 406*a* may protrude from the first conductive member 404 and second conductive member 406 to the space between the first conductive member 404 and second conductive member 406 joined to the inner wall of the housing. The open stubs 406*a*, 406*a* may preferably protrude alternatingly in an interlocking manner. As described above, the open stubs 406*a*, 406*a* may substantially increase the electrical length of the first conductive member and second conductive member, by forming a slow-wave structure and varying capacitance.

The antenna according to another embodiment of the present invention illustrated in FIG. 4 and FIG. 5 provide coupling in two zones.

A first coupling can occur on the perpendicular structure 400 between the separated first conductive member and second conductive member, a second coupling can occur between the first conductive member and second conductive member as they extend in the y direction while joined to the inner wall of the housing.

The third conductive member 408 may extend from the second conductive member 406 to be joined to the inner wall of the housing. The third conductive member 408 may extend in a direction moving further away from the first conductive member 404. The third conductive member 408 may begin at the portion where coupling with the first conductive member 404 ends, and may operate as a radiator.

While the above descriptions have been provided with reference to preferred embodiments of the present invention, those of ordinary skill in the art will understand that the invention can be modified and changed in various ways without departing from the scope and spirit of the present invention defined by the claims appended below.

The invention claimed is:

1. An internal antenna joined to a terminal housing, the internal antenna comprising:

a perpendicular structure formed in a perpendicular direction to a substrate and positioned in contact with an inner wall of a housing;

a first conductive member electrically connected to a feeding point, the first conductive member joined to the perpendicular structure to extend in the perpendicular direction to the substrate; and a second conductive member electrically connected to a ground, the second conductive member joined to the perpendicular structure and separated by a particular distance from the first conductive member to extend in the perpendicular direction to the substrate, wherein the first conductive member is joined to the inner wall of the housing to extend in a first direction orthogonal to the perpendicular direction, and the second conductive member is joined to the inner wall of the housing to extend in the first direction at a particular distance from the first conductive member, wherein the internal antenna further comprises a third conductive member extending from the second conductive member and joined to the inner wall of the housing in a direction moving further away from the first conductive member, and wherein a plurality of open stubs protrude from the first conductive member and the second conductive member along a second direction perpendicular to the first direction of the first conductive member and the second conductive member and joined to the inner wall of the housing.

2. The internal antenna of claim 1, wherein the plurality of open stubs protruding from the first conductive member and the second conductive member protrude alternatingly.

3. The internal antenna of claim 1, further comprising a dielectric protrusion having a meandering structure, the dielectric protrusion protruding from the inner wall of the housing.

4. The internal antenna of claim 3, wherein the dielectric protrusion having a meandering structure comprises an inner sidewall and an outer sidewall, and wherein the first conductive member joined to the perpendicular structure extends while joined to the inner sidewall.

5. The internal antenna of claim 4, wherein the second conductive member joined to the perpendicular structure extends while joined to the outer sidewall.

* * * * *